United States Patent [19]

Hayden

[11] Patent Number: 4,758,170

[45] Date of Patent: Jul. 19, 1988

[54] CURRENT CARRYING INLET VALVE FOR CENTRAL VACUUM SYSTEM

[76] Inventor: Theodore R. D. Hayden, 10291 Springhill Crescent, Richmond, British Columbia, Canada, V7E 1W7

[21] Appl. No.: 59,885

[22] Filed: Jun. 9, 1987

Related U.S. Application Data

[63] Continuation-in-part of Ser. No. 829,270, Feb. 14, 1986, abandoned.

[51] Int. Cl.[4] ..... H01R 13/73

[52] U.S. Cl. ..... 439/142; 439/191; 439/536

[58] Field of Search ..... 200/61.6; 285/7; 15/314; 174/47; 439/190–192, 194–195, 198, 535–536, 142–144

[56] References Cited

U.S. PATENT DOCUMENTS

| | | | |
|---|---|---|---|
| 2,174,811 | 10/1939 | White | 339/123 |
| 2,806,941 | 9/1957 | Graziani | 339/123 |
| 3,076,068 | 1/1963 | Racklyeft | 339/15 |
| 3,258,553 | 6/1966 | Breslin | 15/314 |
| 3,465,111 | 9/1969 | Breslin | 339/16 R |
| 3,483,503 | 12/1969 | Paradiso | 339/15 |
| 4,059,327 | 11/1977 | Vann | 439/535 |
| 4,336,427 | 6/1982 | Lindsay | 339/15 |
| 4,494,815 | 1/1985 | Brzostek et al. | 339/123 |
| 4,664,457 | 5/1987 | Suchy | 439/191 |

*Primary Examiner*—J. Patrick McQuade

*Attorney, Agent, or Firm*—Townsend & Townsend

[57] ABSTRACT

The present invention discloses a current carrying inlet valve for central vacuum system providing tubular elements and connecting fittings with an integral electrical receptacle to permit operation of any electrically driven attachments and/or other cleaning devices, specific to the operation of a central vacuum cleaning system, without the necessity of an electrical outlet in close proximity, to which the location of an inlet valve was hereto restricted.

13 Claims, 2 Drawing Sheets

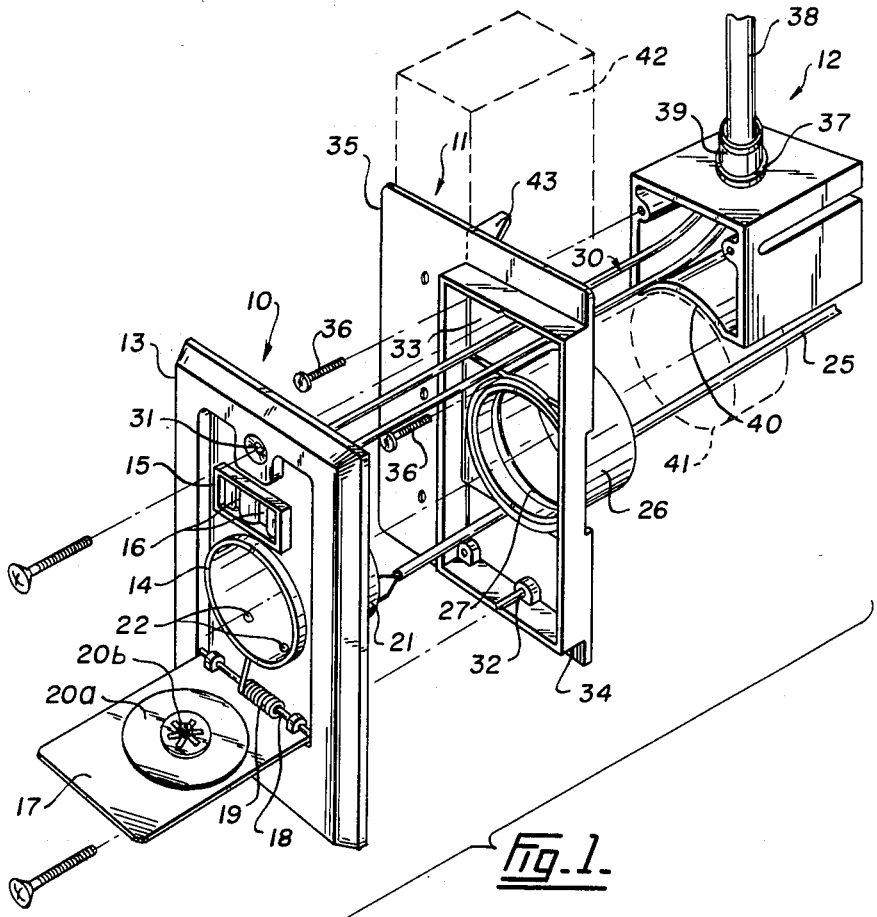
Fig. 1.
Fig. 2.
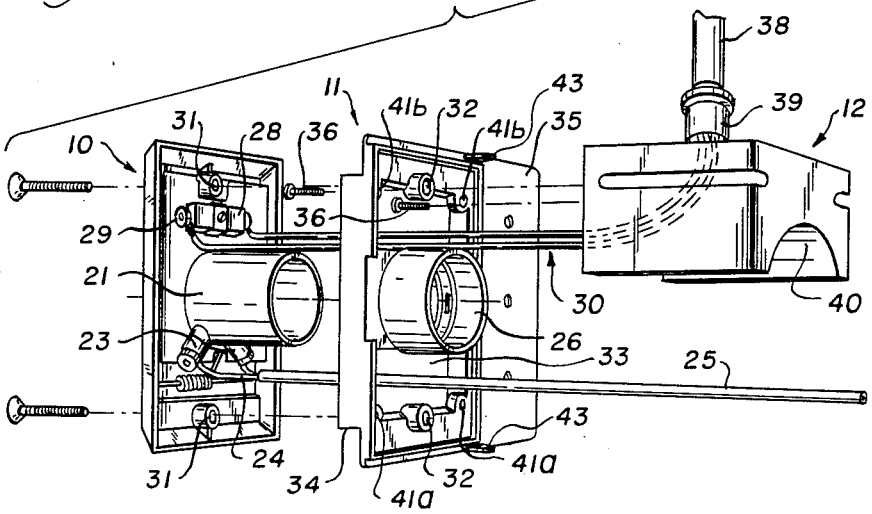

CURRENT CARRYING INLET VALVE FOR CENTRAL VACUUM SYSTEM

CROSS REFERENCE TO RELATED APPLICATION

This application is a continuation-in-part to applicaton Ser. No. 829,270, filed Feb. 14, 1986, now abandoned.

FIELD OF THE INVENTION

This invention relates to inlet valves for central vacuum systems and more particularly to current carrying inlet valves.

DESCRIPTION OF THE PRIOR ART

It is common practise in prior art devices to install central vacuum systems whereby low voltage conductors are connected at each one of a plurality of vacuum inlet valves and terminating at a remote location of a vacuum power unit. Some of these prior art inlet valves are disclosed in U.S. Pats. Nos. 3,036,170 to Forney; 3,076,068 to Racklyeft; 4,336,427 to Lindsay; 3,042,765 to Hunt; 3,465,111 to Breslin; and 3,928,715 to Holden.

This arrangement allows the activation and deactivation of a vacuum power unit simply by inserting the metallic nozzle of a vacuum hose into an inlet valve. The metallic nozzle would contact two low voltage conductors and close the low voltage circuit.

The simultaneous use of electrically activated attachments such as power brush required hereto the availability of a nearby 120 VAC repectacle into which the male terminals of an electrical power cord plug would be inserted in order to render an electrically activated attachment operational.

This arrangement limited the installation of vacuum inlet valves only in close proximity of electrical receptacles, at a distance determined by the length of the 120 VAC current carrying cord as supplied by the manufacturers of electrically operated attachments and/or other cleaning devices specific to the operation of a central vacuum system.

Hence, electric supply for the operation of these cleaning devices had to be installed by other trades, while vacuum inlet valves were installed as separate entities. The latter efforts made no provision for the completion of integrated 120 VAC electrical circuitry in conjunction with the permanently installed central vacuum system and a plurality of inlet valve locations.

As a result, pre-designed concepts such as architectural or mechanical designs have to be compromised and/or totally altered to facilitate the installation of a central vacuum system. Similarly, time, labour and materials must be independently consumed, as independent paths for the central vacuum system and for the 120 VAC electrical circuitry must be provided.

There is therefore a requirement for establishing a combination of two concurrent electrical circuits operating simultaneously with the operation of an air suction system and the operation of electrically driven attachments and/or devices specific to the operation of a central vacuum system.

In addition, the installation of vacuum inlet valves require the use of flanged tees which had to be installed in association with a metal mounting plate, a gasket, a plasterguard and a number of screws. The installer had the tedious task of assembling all these components and hence the installation time of the vacuum system was considerably increased.

As indicated earlier, the fact that the installation of a steel mounting plate normally requires as many as ten components, the extra time spent in assembling them in the field add significantly to the labour portion of the installation costs.

There is therefore a requirement for an integral mounting plate which can permit the installation of inlet valves in finished and unfinished walls.

SUMMARY OF THE INVENTION

It is therefore an object of the present invention to provide a current carrying inlet valve incorporating access to an air suction inlet with low voltage thermostat connectors to remotely activate and deactivate a central vaccum power unit and an electrical power receptacle for the operation of electrically driven attachments and/or devices specific to the operation of a central vacuum system.

Another object of the present invention is to provide an integral mounting plate for a current carrying inlet valve which can permit the installation of inlet valves in finished and unfinished walls. The mounting plate has a tubular fitting element with a composite O-ring which extends around the interior peripheral surface of the tubular element. The mounting plate also includes an opening above and below the tubular fitting element to allow passage of electrical wiring to an electrical power receptacle on the current carrying inlet valve.

Another object of the present invention is to provide a wiring compartment having a curvilinear concavity to allow the securing of tubular fittings by means of which access to an air suction piping system is achieved. Because of its specific design, the wiring compartment can be installed along with the mounting plate in finished and unfinished walls without the aid of special tools.

Accordingly, this invention provides a current carrying inlet valve for central vacuum system comprising in combination: (a) an inlet valve body having an air suction inlet and an electrical receptacle in the anterior surface, said air suction inlet having a tubular fitting element forming a female hub at one end and a male spigot at the distal end and having low voltage electrical contact elements protruding from within the annular interior surface of said female hub and terminating at corresponding connector lugs, said electrical receptacle having plug-receiving cavities with metal conductors terminating at corresponding connector lugs opposite said interior surface, said air suction inlet and said electrical receptacle being covered by means of a spring-loaded hinged cover with sealing means for sealing said air suction inlet; (b) a convertible mounting plate for holding said inlet valve body against sides of wall boarding material and having a centered tubular fitting element forming a peripherally engageable female hub at the anterior surface and a peripherally engageable male spigot at the distal end thereof, a composite O-ring extends annularly on the interior peripheral surface of said female hub forming an airtight seal when said male spigot of said inlet body is axially inserted therein, an opening above and below said tubular fitting element to permit electrical conductors to connect to said connector lugs of said inlet body, said mounting plate having a rectlinear edge protruding from the anterior surface and enclosing said opening and said centered tubular fitting element; (c) a wiring compartment for receiving electrical leads from a source, engageable to said convertible mounting plate and having one side with a curvilinear concavity to allow placement and rotation of tubular fittings to said convertible mounting plate, an aperture on an opposite side of said concavity and an open anterior face, said electrical leads being led from said source through said aperture, said open anterior face, an opening above said centered tubular fitting element of said convertible mounting plate to said metal conductors.

DRAWINGS

Particular embodiments of the invention will be understood in conjunction with the accompanying drawings in which:

FIG. 1 is an exploded view of the current carrying inlet valve used in the present invention;

FIG. 2 is another exploded view thereof;

DESCRIPTION OF THE PREFERRED EMBODIMENTS

Figure 3:
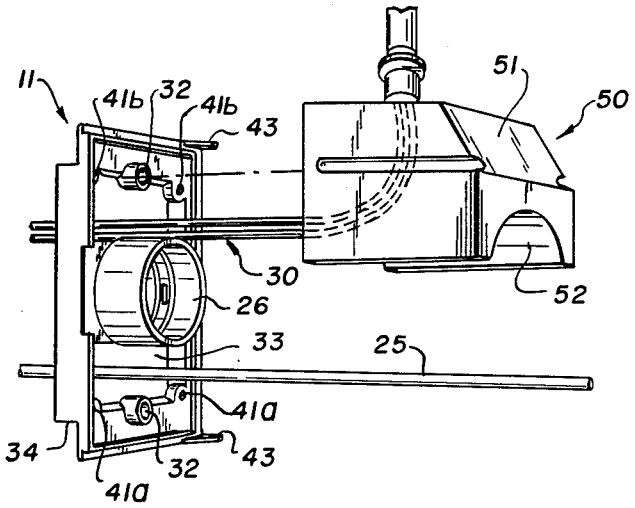
FIG. 3 is an exploded view of the integral mounting plate and wiring compartment according to another embodiment of the invention.

Referring now to FIG. 1 we have shown the three basic components of the current carrying inlet valve assembly used in the present invention. It is comprised of an inlet valve body 10, a convertible mounting plate 11 and a wiring compartment 12. The inlet valve body 10 consists of a rectangular face plate 13 embodying an air suction inlet 14, and a 120 VAC electrical power receptacle 15 with two plug receiving cavities 16. A hinged door 17, shown in the open position, is retained in place with a metal shaft 18 and a torsion spring 19. Door 17 protects the electrical power receptacle 15 and seals the annular rim of air suction inlet 14 with a sealing gasket 20*a* secured to the inside of the hinged door 17 by means of a press-fitted push-nut 20*b*. The air suction inlet 14 embodies a tubular fitting element that is dimensioned to form a female hub on the anterior side of the face plate 13 and a male spigot 21 at the distal end. Low voltage spring loaded contacts 22 terminate at two screw-type connector terminals 23 protruding at the rear of face plate 10. Low voltage conductors 24 are connected to these terminals. From there, the connecting low voltage conductor 25 extends along an entire air suction system (not shown), terminating at a vacuum power unit (not shown), thereby completing a low voltage circuit (not shown). By insertion of a metallic vacuum hose nozzle, low voltage spring loaded contacts 22 will make contact, close the low voltage circuit and thereby activate the remote vacuum power unit. The electrical power receptacle 15 is dimensioned to receive a 120 VAC power capacity plug-type connector. The 120 VAC power receptacle 15 is adaptable for use of European standard 220 V power receptacles. It will be understood by those knowledgeble in this art that the power receptacle need not be limited to any North American or European size receptacle.

The perspective exploded view of FIG. 1 depicts the inlet valve body 10 in a position to be axially telescoped in the hub 26 of convertible mounting plate 11, wherein the male spigot 21, protruding from the rear of the inlet valve body 10, seats itself onto the composite O-ring 27 which extends annularly on the interior surface of the tubular hub 26. The composite O-ring 27 is peripherally held in place in an annular retaining groove in the interior of the mounting plate hub 26, effecting an airtight seal. The 120 VAC electrical power receptacle 15 is secured to the inlet valve body as an integral part. The 120 VAC electrical power receptacle 15 is dimensioned to be inserted into a retaining aperture 28 in the inlet valve body 10 and held in place with latching tabs. Extending through the aperture 28, the 120 VAC electrical power receptacle reveals at the distal end two connector lugs 29 to facilitate the attachment of 120 VAC electrical conductors 30. Hence, by connecting the 120 VAC conductors 30 to connector lugs 29, a separate 120 VAC circuit is established, facilitating simultaneous use of 120 VAC power source in conjunction with a low voltage circuit. Two recessed mounting screw apertures 31 are centered respectively along the upper and lower anterior portion of face plate 13 to receive mounting screws, for fastening inlet valve body 10 to convertible mounting plate 11.

The convertible mounting plate 11 embodies a tubular fitting element 26 forming a peripherally engageable female hub on the anterior side of plate 11 and a peripherally engageable male spigot on the distal end thereof. An opening 33 above and below element 26 permits electrical conductors 30 to pass through convertible mounting plate 11 for connection to connector lugs 29 at the rear of inlet valve body 10. A protruding edge 34 positioned around the mounting plate 11, protects the electrical connectors when wall boarding is positioned over the mounting plate 11.

Forming an integral part of the convertible mounting plate 11 is a pre-drilled nailing flange 35 to permit securing the convertible mounting plate to a wall stud 42 when the inlet valve body 10 is to be installed before the application of plaster board or similar material during construction of a dwelling or building. A pair of raised prongs 43 extend behind mounting plate 11 at flange 35 to permit accurate alignment of plate 11 onto wall stud 42. The convertible mounting plate 11 has been specifically designed to facilitate removal of the pre-drilled nailing flange 35 to render installation of the inlet valve body 10, the convertible mounting plate 11 and the wiring compartment 12 into finished construction i.e. where rigid wall boarding has previously been installed. Removal of the pre-drilled nailing flange 35 is achieved by running a sharp bladed knife along the outer protruding edge 34 and twisting the pre-drilled nailing flange off, thereby converting the mounting plate for insertion into a pre-cut aperture in previously installed wall boarding.

The wiring compartment 12 is held in place by two screws 36 to the rear of the mounting plate 11 to effect a tight fit. An annular opening 37 in the upper surface of the wiring compartment 12 provides entry for the 120 VAC conductors 38 through an approved entry connector 39. The 120 VAC conductors 38 thus enter the wiring compartment 12 and extend through the aperture 33 of the convertible mounting plate 11 and terminate at the 120 VAC connectors 29 at the rear the inlet valve body 10.

While the fastening of the wiring compartment 12 to the convertible mounting plate 11 requires only two screws 36, the convertible mounting plate embodies four screw bosses 41*a* and 41*b*. This permits fastening of the wiring compartment 12 either above or below the hub 26 of the convertible mounting plate 11.

The curvilinear concavity 40 at the bottom of the wiring compartment 12 permits the securing of tubular fittings, as denoted by a phantom line 41, by means of which access to the air suction piping system is achieved.

Referring now to FIG. 3 we have shown a perspective exploded view of the mounting plate 11 and a modified wiring compartment 50. Convertible mounting plate 11 is shown without the nailing flange. This arrangement would be used in finished dwellings where rigid wall boarding has previously been installed. In this situation a hole would be cut in the wall to permit insertion of mounting plate 11 and wiring compartment 50. Where required, wiring compartment 50 would be secured to mounting plate 11 and both parts would be inserted in the pre-cut hole to permit the installation of the inlet valve body 10 on the outside of the wall. The shape of wiring compartment 50 allows the two parts to be inserted inside the hole and through the wall where the depth of the wall may only be three to four inches. The bevelled rear face 51 would therefore make it easier for an installer to fit the completed assembly into the hole of the finished wall. Otherwise, the two separate parts i.e. wiring compartment 50 and mounting plate 11 would have to be secured together after they have been separately inserted in the hole of the finished wall therefore making the assembly task more difficult.

Various electrical codes require that wiring compartments 12 and 50 meet certain standards regarding their internal volumes. On the other hand, a wiring compartment which is too bulky would be unusable for the present application. Accordingly, the use of the curvilinear concavity 40 of wiring compartment 12 and curvilinear concavity 52 of wiring compartment 50 help meet the minimum internal volume required by the standards and still permit the separate components of the vacuum inlet valve to be assembled in a relatively simple manner.

As will be apparent to those skilled in the art in light of the foregoing disclosure, many alterations and modifications are possible in the practise of this invention without departing from the spirit or scope thereof. Accordingly, the scope of the invention is to be construed in accordance with the substance defined by the following claims.

I claim:

1. A current carrying inlet valve for central vacuum system, comprising in combination:

(a) an inlet valve body having an air suction inlet and an electrical receptacle in the anterior surface, said air suction inlet having a tubular fitting element forming a female hub at one end and a male spigot at the distal end and having low voltage electrical contact elements protruding from within the annular interior surface of said female hub and terminating at corresponding connector lugs, said electrical receptacle having plug-receiving cavities with metal conductors terminating at corresponding connector lugs opposite said anterior surface, said air suction inlet and said electrical receptacle being covered by means of a spring-loaded hinged cover with sealing means for sealing said air suction inlet;

(b) a mounting plate for holding said inlet valve body against sides of wall boarding material and having a centered tubular fitting element forming a peripherally engageable female hub at the anterior surface and a peripherally engageable male spigot at the distal end thereof, a composite O-ring extends annularly on the interior peripheral surface of said tubular fitting element forming an airtight seal when said male spigot of said inlet body is axially inserted therein, an opening above and below said tubular fitting element to permit electrical conductors to connect to said connector lugs of said inlet body, said mounting plate having a rectilinear edge protruding from the anterior surface and enclosing said opening and said centered tubular fitting element;

(c) a wiring compartment for receiving electrical leads from a source, engageable to said mounting plate and having one side with a curvilinear concavity to allow placement and rotation of tubular fittings to said mounting plate, an aperture at an opposite side of said concavity and an open anterior face, said electrical leads being led from said source through said aperture, said open anterior face, through said opening above said centered tubular fitting element of said mounting plate to said metal conductors.

2. A current carrying inlet valve as defined in claim 1 wherein said mounting plate further comprises a removable flange extending outwardly along one side thereof.

3. A current carrying inlet valve as defined in claim 2 wherein said air suction inlet and said electrical receptacle form an integral part of said inlet valve body.

4. A current carrying inlet valve as defined in claim 3 wherein said electrical receptacle comprises a 120 VAC receptacle.

5. A current carrying inlet valve as defined in claim 4 wherein said mounting plate further includes means for fitting and locating said plate adjacent a wall stud.

6. A current carrying inlet valve as defined in claim 5 wherein said means comprises a pair of raised prongs extending behind said plate adjacent said flange.

7. A current carrying inlet valve as defined in claim 6 wherein said wiring compartment has an upwardly slanted rear face opposite said open anterior face.

8. A mounting plate for holding an inlet valve body against sides of wall boarding material, comprising:

a centered tubular fitting element forming a peripherally engageable female hub at the anterior surface and a peripherally engageable male spigot at the distal end thereof, a composite O-ring extending annularly on the interior peripheral surface of said female hub forming an airtight seal when a male spigot of said inlet valve body is axially inserted therein, said plate having an opening above and below said centered tubular fitting element to permit electrical conductors to pass therethrough to said inlet valve body; and a rectilinear edge protruding from the anterior surface and enclosing said opening and said centered tubular fitting element.

9. A mounting plate as defined in claim 8 further comprising a removable flange extending outwardly along one side thereof.

10. A convertible mounting plate as defined in claim 9 wherein said mounting plate further includes means for fitting and locating said plate adjacent a wall stud.

11. A convertible mounting plate as defined in claim 10 wherein said means comprises a pair of raised prongs extending behind said plate adjacent said flange.

12. A wiring compartment for use with inlet valve body mounting plate in a central vacuum system, comprising:

a curvilinear concavity on one side to allow connection and rotation of tubular fittings of a central vacuum system to said mounting plate;

an aperture on a side opposite said concavity for receiving electrical leads from a source;

an open anterior face, said electrical leads being led from said source through said aperture, said open anterior face, said mounting plate to said inlet valve body.

13. A wiring compartment as defined in claim 12 wherein said compartment has an upwardly slanted rear face opposite said open anterior face.

* * * * *